US007664448B2

(12) United States Patent
Lee et al.

(10) Patent No.: US 7,664,448 B2
(45) Date of Patent: Feb. 16, 2010

(54) APPARATUS AND METHOD OF HEATING IMAGE ON RECORDABLE MATERIAL

(75) Inventors: Dong Woo Lee, Suwon-si (KR); Su Ho Shin, Seongnam-si (KR); Hwan Guem Kim, Seoul (KR); Tae Gyu Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 233 days.

(21) Appl. No.: 11/768,432

(22) Filed: Jun. 26, 2007

(65) Prior Publication Data

US 2008/0219723 A1 Sep. 11, 2008

(30) Foreign Application Priority Data

Mar. 6, 2007 (KR) ..... 10-2007-0021860

(51) Int. Cl.
*G03G 15/20* (2006.01)

(52) U.S. Cl. ..... 399/329

(58) Field of Classification Search ..... 399/107, 399/122, 320, 328, 329; 219/216, 619
See application file for complete search history.

(56) References Cited

U.S. PATENT DOCUMENTS

| | | | | |
|---|---|---|---|---|
| 5,148,226 | A | 9/1992 | Setoriyama et al. | |
| 5,532,806 | A * | 7/1996 | Sugita et al. | 399/328 |
| 5,960,243 | A * | 9/1999 | Daigo et al. | 399/329 |
| 6,049,691 | A | 4/2000 | Abe et al. | |
| 6,075,228 | A | 6/2000 | Goto et al. | |
| 6,895,207 | B2 * | 5/2005 | Kataoka et al. | 399/328 |
| 7,366,455 | B2 * | 4/2008 | Iwasaki et al. | 399/329 |
| 2003/0058320 | A1 | 3/2003 | Sano et al. | |
| 2008/0247789 | A1 * | 10/2008 | Shin et al. | 399/329 |
| 2009/0016789 | A1 * | 1/2009 | Kim et al. | 399/329 |

FOREIGN PATENT DOCUMENTS

| | | |
|---|---|---|
| JP | 2003-15445 | 1/2003 |
| JP | 2005-234290 | 9/2005 |
| JP | 2006-133471 | 5/2006 |
| KR | 1991-7722 | 5/1991 |
| KR | 1998-17868 | 6/1998 |
| KR | 2004-21599 | 3/2004 |
| KR | 2006-39329 | 5/2006 |

OTHER PUBLICATIONS

European Search Report dated Jul. 15, 2008 issued in EP Application No. 07111234.6.

* cited by examiner

*Primary Examiner*—Hoan H Tran
(74) *Attorney, Agent, or Firm*—Stanzione & Kim LLP

(57) ABSTRACT

An image heating apparatus includes a pressure roller, a belting film to circulate while partially connecting with the pressure roller, a support member to be provided in the belting film and comprises a guide to guide the circulating of the belting film, a nip spring to comprise a nip portion to form a nip between the belting film and the pressure roller, and a support portion to support the nip portion against the support member, and a heater to be provided adjacent to the nip spring and transfer heat to the image through the belting film.

30 Claims, 14 Drawing Sheets

APPARATUS AND METHOD OF HEATING IMAGE ON RECORDABLE MATERIAL

CROSS-REFERENCE TO RELATED APPLICATIONS

This application claims priority under 35 U.S.C §119(a) from Korean Patent Application No. 10-2007-0021860, filed on Mar. 6, 2007, in the Korean Intellectual Property Office, the disclosure of which is incorporated herein in its entity by reference.

BACKGROUND OF THE INVENTION

1. Field of the Invention

The present general inventive concept relates to an image heating apparatus, and more particularly, to a method and apparatus to fuse an image, which can reduce a warm-up time and also can improve a fusing quality.

2. Description of the Related Art

An image heating apparatus generally includes a heating roller and a pressure roller. The image heating apparatus may pass a printing paper, formed with an image, through the heating roller and the pressure roller and thereby fuse the image on the printing paper. Accordingly, the image heating apparatus may be used for a copying machine, a printer, a facsimile, and the like. Also, the image heating apparatus may be used to fuse character or image information on a printing paper as an image.

A main task of the image heating apparatus may be to fuse an image identical to an original image on the printing paper. Also, the image heating apparatus may reduce an initial warm-up time and power consumption.

FIG. 1 is a cross-sectional view illustrating a conventional printer, and FIG. 2 is an enlarged cross-sectional view illustrating a conventional image heating apparatus 100 in the printer of FIG. 1. The image heating apparatus 100 shown in FIGS. 1 and 2 is disclosed in U.S. Pat. No. 5,148,226, issued on Sep. 15, 1992.

Referring to FIG. 1, the printer may be, for example, a laser beam printer having a housing 65. The printer includes a processing cartridge 60. Also, the processing cartridge 60 includes a rotating drum 61, a charger 62, a developing device, and a cleaning device. The processing cartridge 60 is mounted to be separable from the printer when a cover 65 is open.

When the printer is operating, the rotating drum 61 rotates along an arrow direction shown in FIG. 1, that is, rotates clockwise. A surface of the rotating drum 61 is uniformly charged by the charger 62 and exposed to a scanning laser beam 67. In this instance, the scanning laser beam 67 is scanned from a laser scanner 66, and is controlled in correspondence to image information to be recorded. Accordingly, the rotating drum 61 defines an electrostatic latent image. In this instance, the latent image is developed into a toner image while passing through a toner storage unit 63.

In this instance, one sheet of a printing paper P is supplied from a cassette 68. While the printing paper P is passing through the rotating drum 61 and an image transfer roller 72, the toner image is transferred from the rotating drum 61 to the printing paper P. Also, the surface of the rotating drum 61 is cleaned while passing through a cleaning member 64. In this instance, contaminants remaining on the surface of the rotating drum 61 may be removed. The printing paper P with the formed toner image moves to the image heating apparatus 100. the printing paper P fed along paths 71, 73, 74, and 75.

Referring to FIG. 2, the image heating apparatus 100 includes a pressure roller 10, a fixed structure 13, an insulating member 20, a heater 19, and a film 21. The fixed structure 13 is fixed in the image heating apparatus 100. Also, the fixed structure 13 includes front and rear walls 15 and 16 to guide the film 21, and a middle portion connected between the front and rear walls 15 and 16. The heater 19 and the insulating member 20 are provided on the middle portion in a lower portion of the fixed structure 13. The film 21 is formed in a shape of a belt, and contains the fixed structure 13 and the heater 19 and thereby rotates. The paper P with a toner image Ta passes through a region N corresponding to the heater 19 such that the toner image Ta is fused as a fused image Tb and then discharged using a guide 33 and rollers 34 and 35. When the film 21 rotates in a direction A, a pressure f is exerted in a region B.

The fixed structure 13 and the heater 19 are formed in a solid body. Also, the fixed structure 13 and the heater 19 may simultaneously move up and down above the pressure roller 10. Accordingly, the fixed structure 13 and the heater 19 may contact the printing paper P on the same plane exclusively and at all times.

Also, since the fixed structure 13 and the heater 19 may contact each other along the lengthwise direction with the same characteristics, it may be impossible to change a nip characteristic along the lengthwise direction of the pressure roller 10. In this instance, when the pressure roller 10 is formed in a simple cylindrical shape, pressure is irregularly distributed in a nip formed between the pressure roller 10 and the film 21. A central portion based on the pressure roller 10 has greater pressure than the pressure in margin portions, which are provided in both ends. Accordingly, as disclosed in U.S. Pat. No. 5,148,226, the pressure roller 10 is formed in a shape of a reverse-crown, so that the central portion may have substantially identical pressure as the pressure in margin portions.

Also, in the fixed structure 13 in which the heater 19 is fixed, the heater 19 may directly transfer pressure from the pressure roller 10 and the printing paper P. Accordingly, when greater pressure is applied to the heater 19, some damage may be inflicted on the surface of the heater 19, although a bottom surface of the heater 19 is protected by a surface protecting layer.

Therefore, the conventional method and apparatus cannot reduce a warm-up time and improve a fusing quality when fusing the image.

SUMMARY OF THE INVENTION

The present general inventive concept provides an image heating apparatus which can adjust a deformation of a pressure roller and also pressure distribution between a film and the pressure roller.

The present general inventive concept also provides an image heating apparatus which can increase an effective width of a nip provided between a film and a pressure roller.

The present general inventive concept also provides an image heating apparatus which can form a uniform pressure distribution between a film and a pressure roller.

The present general inventive concept also provides an image heating apparatus which can quickly achieve an initial warm-up of a nip and also readily control pressure adjustment or pressure distribution in the nip.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image heating apparatus including a pressure member, a film to form a nip with the pressure member, a heater to be provided adjacent to the nip, and a nip spring to elastically support the film in correspondence to the nip. The nip may be formed between the film and the pressure member while the nip spring partially supports the film. Also, the heater may be movably mounted to the nip spring or fixed around the nip spring to transfer heat to the nip. Since the nip spring is elastically deformed, the nip may form a uniform pressure distribution. Also, it is possible to more readily adjust the width of the nip, the pressure distribution in the nip, the shape of the nip, and the like by adjusting a characteristic of the nip spring.

A belting film forms a caterpillar and may be used for the film. Specifically, the belting film may continuously circulate around the heater and the nip spring. Also, the heater is mounted to the nip spring to be movable with an elastic deformation. In this instance, when the heater is provided in an inner place of the nip spring, the pressure between the nip spring and the pressure roller may not be transferred to the heater. Accordingly, it is possible to form pressure greater than the pressure in the nip. Also, it is possible to reduce the temperature in the nip due to the increase in the pressure. Also, since the heater is provided in the inner space of the nip spring, it is possible to prevent the heater from being damaged or destroyed due to the pressure in the nip.

In this instance, the heater corresponds to a heating instrument which can generate heat sufficient to fuse an image. A heating element, such as a halogen lamp, an electrothermal wire, and the like, may be used for the heater. As described above, the heater may be provided in the nip spring. Also, the heater may be mounted to a support member to support the nip spring.

The foregoing and/or other aspects of the present general inventive concept may also be achieved by providing an apparatus to fuse an image on a recording medium, the apparatus including a pressure roller, a belting film to circulate while partially connecting with the pressure roller, a support member to be provided in the belting film and comprises a guide to guide the belting film to circulate along a path thereof, a nip spring to support an inner surface of the belting film and comprises a nip portion to form a nip between the belting film and the pressure roller, and a support portion to support the nip portion against the support member, and a heater to be provided adjacent to the nip spring and transfer heat to the image through the belting film.

In this instance, the nip spring may include a nip portion and a support portion. The nip spring may be supported by the nip portion and the support portion, and may be formed in a shape of a trapezoid or a quadrangle with a top corner open. The nip portion and the support portion may be formed using the same material. Also, the nip portion and the support portion may be formed using different materials respectively.

Also, the heater may be provided to the nip portion or the support portion or may be fixed to the support member. Also, the heater may utilize various types of heating instruments, such as a halogen lamp, a heating wire, and the like. The heater may be provided on a top surface or a bottom surface of the nip portion.

The nip portion may be formed in various types of shapes. Specifically, since the nip portion is formed of a metal plate, the nip portion may be readily processed into a desired shape. As an example, the width of the nip may be increased by processing the nip portion, contacting with the pressure roller, with the same or similar curvature as the curvature of the pressure roller. Also, it is possible to variously construct the nip to have different elastic characteristics in one nip spring by variously modifying the width or thickness of the nip portion along the lengthwise direction of the nip spring. Also, it is possible to adjust elasticity by forming a bent structure in a form of a support portion. Also, the support portion may have a different elastic characteristic by forming a hole in the support portion or providing a stiffener to the support portion.

Also, by constructing the nip spring to have a symmetrical cross section, an inlet through which a recording medium with a pre-fused image enters may have the same elastic characteristic as the elastic characteristic in an outlet through which the recording medium with a fused image exits. Also, by constructing the nip spring to have an asymmetrical cross section, the inlet may have a different elastic characteristic from the elastic characteristic in the outlet. In this instance, the shape or the thickness of the support portion may be changed to symmetrically or asymmetrically form the cross section of the nip spring.

The foregoing and/or other aspects of the present general inventive concept may also be achieved by providing a method of heating an image, the method including: forming a nip using a pressure roller and a film which partially connects with the pressure roller; elastically supporting the film in correspondence to the nip by using the nip spring; driving the pressure roller to pass a recording medium, with the image formed on the recording medium, via the nip; and transferring heat to the image passing through the nip using a heater which is provided adjacent to the nip.

A structure using the nip spring may be utilized to form the nip. In this instance, the nip spring may elastically support the nip in a partially contacting narrow area. Also, it is possible to uniformly form the pressure distribution over the entire nip using deformation of the nip spring.

Also, it is possible to increase pressure in the nip using the nip spring. Also, since damage to the heater may be prevented, it is possible to comparatively reduce the temperature necessary for heating. Also, it is possible to improve performance of a printer or a copying machine by increasing a heating speed.

The foregoing and/or other aspects of the present general inventive concept may also be achieved by providing an image forming apparatus including a processing unit to form an image on a printing medium, and an image heating apparatus comprising a pressure member, a film to form a nip with the pressure member such that the printing medium with the image passes through the nip, a heater provided adjacent to the nip to apply heat to the printing medium, and a nip spring to elastically support the film with respect to the pressure member.

The foregoing and/or other aspects of the present general inventive concept may also be achieved by providing an image forming apparatus including a processing unit to form an image on a printing medium, and an image heating apparatus comprising a pressure member, a film to form a nip with the pressure member such that the printing medium with the image passes through the nip, a guide to guide the film to rotate along a path including the nip, a nip spring elastically mounted on the guide to elastically support the film with respect to one of the pressure member and the guide, and a heater mounted on the nip spring to apply heat to the printing medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
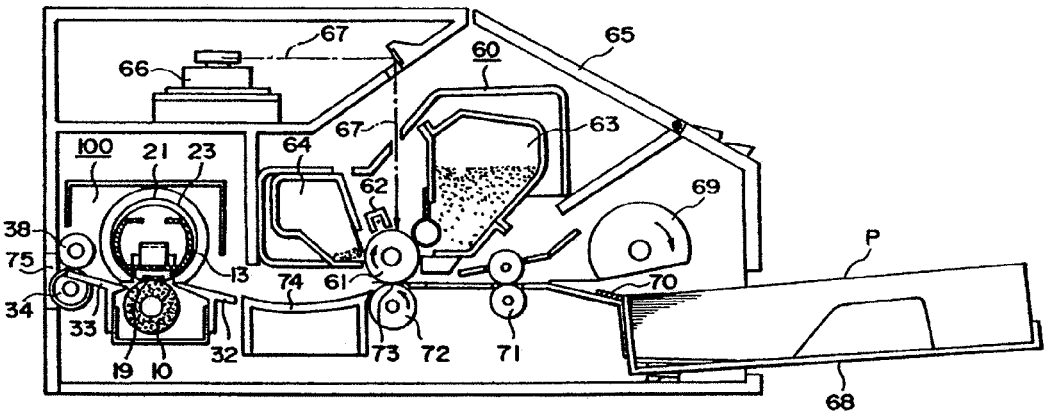
FIG. 1 (CONVENTIONAL ART)
FIG. 1 is a cross-sectional view illustrating a conventional printer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
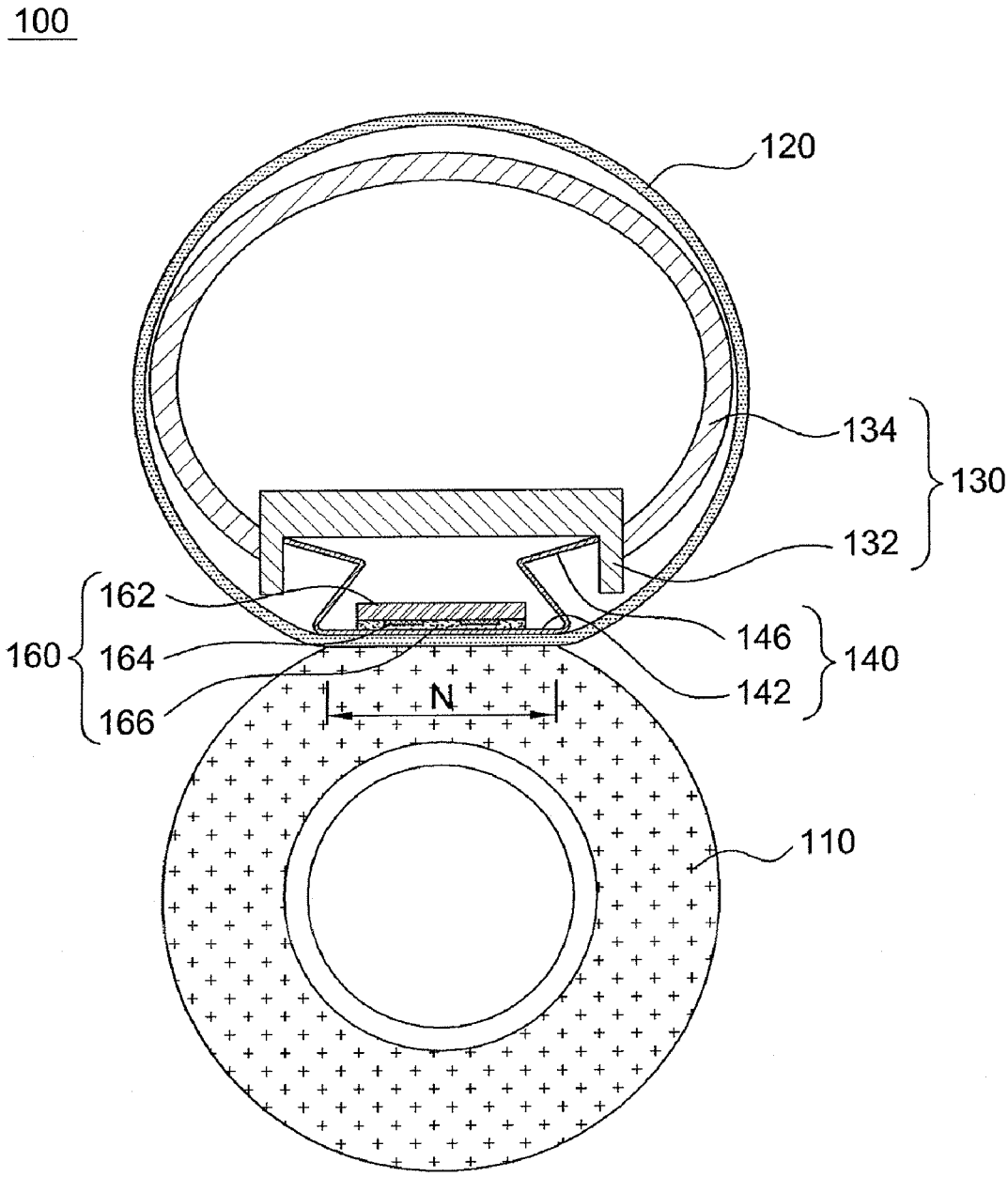
FIG. 3 is a cross-sectional view illustrating an image heating apparatus according to an embodiment of the present general inventive concept.
Figure 4:
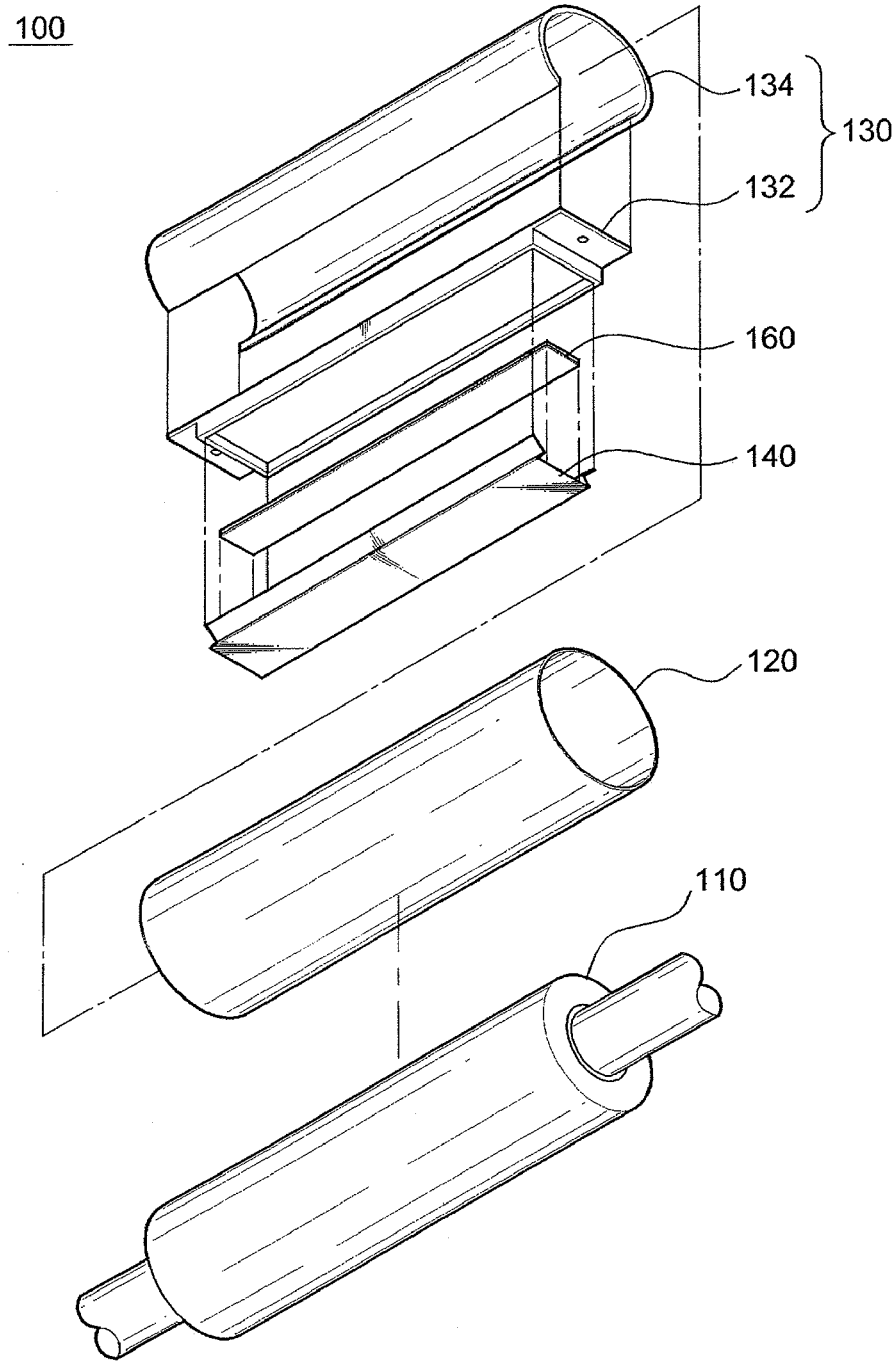
FIG. 4 is an exploded perspective view illustrating the image heating apparatus of FIG. 3.

FIG. 3 is a cross-sectional view illustrating an image heating apparatus 100 according to an embodiment of the present general inventive concept, and FIG. 4 is an exploded perspective view illustrating the image heating apparatus 100 of FIG. 3.

Figure 2:
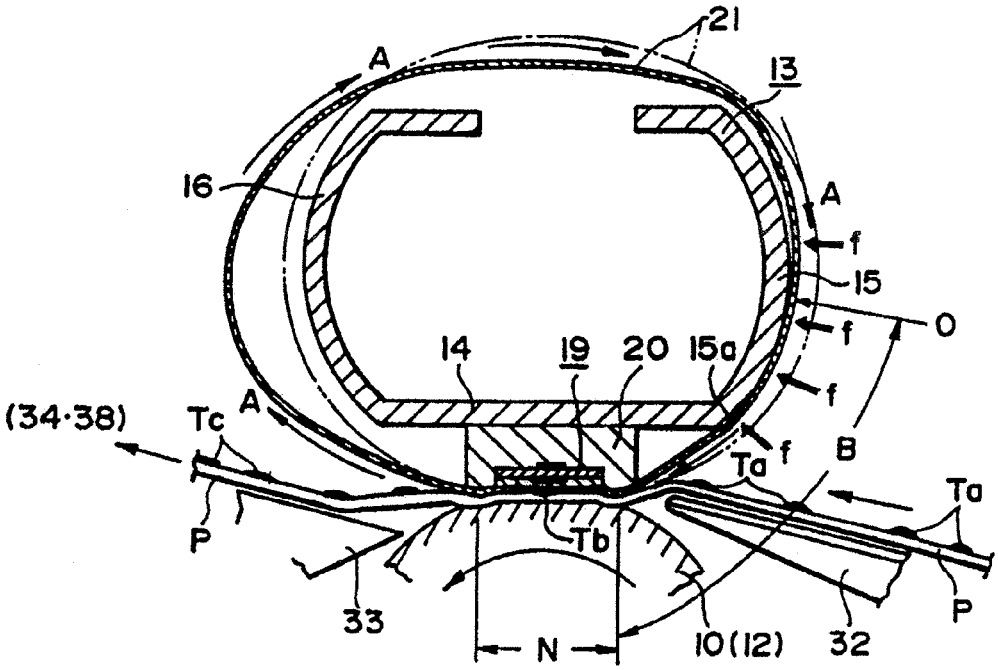
FIG. 2 (CONVENTIONAL ART)
FIG. 2 is an enlarged cross-sectional view illustrating a conventional image heating apparatus in the printer of FIG. 1.

The image heating apparatus 100 may be installed in an apparatus including a printing function, such as a copying machine, a printer, a facsimile, and the like. Also, the image heating apparatus 100 may fuse a toner image on a printing paper or other recording medium. A specific installation location and the like may be known by referring to descriptions related to the image heating apparatus 100 of the conventional printer of FIGS. 1 and 2 or other image heating apparatuses. That is, the conventional printer of FIG. 1 may have the image heating apparatus 100 of FIGS. 3 and 4. Thus, descriptions of conventional components of the image forming apparatus will be omitted.

Referring to FIGS. 3 and 4, the image heating apparatus 100 includes a pressure roller 110, a belting film 120, a support member 130, a nip spring 140, and a heater 160. The support member 130 is provided above the pressure roller 110. The nip spring 140 is supported by the support member 130, and includes the heater 160. The belting film 120 contains the support member 130, the nip spring 140, and the heater 160. In this instance, the belting film 120 may pass through a space between the pressure roller 110 and the nip spring 140. Specifically, the belting film 120 may move in correspondence to a rotation of the pressure roller 110 and circulate around the contained support member 130, the nip spring 140, and the heater 160 while forming a closed orbit. Also, the nip spring 140 may elastically support the belting film 120. A nip N may be formed between the pressure roller 110 and the nip spring 140.

The pressure roller 110 may be rotatably mounted to a shaft rotate together with a rotational shaft. Also, the pressure roller 110 may include a surface layer formed using rubber or an elastic material. Also, the pressure roller 110 may transfer a recording medium, formed with a pre-fused toner image, to pass through the nip N. Referring to FIG. 3, the pressure roller 110 and the support member 130 are vertically provided. However, the present general inventive concept is not limited thereto. Specifically, the pressure roller 110 and the support member 130 may be provided in a slightly oblique shape. Also, a location between the pressure roller 110 and the support member 130 may be reversed so that the pressure roller 110 may be placed above the support member 130.

The support member 130 is provided in a fixed location above the pressure roller 110 in a printer. The support member 130 includes a support body 132 and a guide 134. The support body 132 may fix and support the nip spring 140, and the guide 134 may guide the circulating of the belting film 120. In this instance, the support body 132 may be formed with a space to receive the nip spring 140 and the heater 160. The nip spring 140, mounted with the heater 160, is provided in the space. Also, the guide 134 guides the belting film 120 to rotate with respect to an axis therein or to circulate along a path formed around the guide 134. Accordingly, the guide 134 may be formed in a circular or elliptical shape. Also, the guide 134 may be formed in an integrated type or a separated type.

The support member 130 may be extended along the pressure roller 110. In this case, the support member 130 has a width greater than the width of a recording medium, which is also applied to the width of the pressure roller 110. Also, in the present embodiment, although the support member 130 is provided in the fixed location, the support member 130 may be elastically supported and may move within a comparatively small range depending upon embodiments.

The belting film 120 may be formed using a heat resistant material, and partially transfer heat, generated from the heater 160, to a toner image. Also, the belting film 120 may have a circumference greater than the circumference of the support body 132 and the guide 134. In the present embodiment, the belting film 120 is engaged with the recording medium or the pressure roller 110 and thereby passively rotates. Also, according to another embodiment of the present general inventive concept, a different device to rotate the belting film 120 may be utilized.

The nip spring 140 includes a nip portion 142 and a support portion 146. The nip spring 140 is mounted to the support body 132 of the support member 130. The nip portion 142 may make a side surface contact with an inner surface of the belting film 120, and form a press-contacting nip N between the pressure roller 110 and the belting film 120. The support portion 146 connects with both ends of the nip portion 142, and supports the nip portion 142 in a form of a table. Also, the nip portion 142 may be partially deformed at a contacting portion with the pressure roller 110 or the recording medium due to elasticity. Also, the support member 146 may be partially deformed due to elasticity and thereby elastically support the belting film 120.

The heater 160 is provided in the nip portion 142. In this instance, the heater 160 includes a plate 162, a heating pattern 164, and a preventing layer 166. The heater 160 may partially heat the film 120, which is adjacent to the nip spring 140, in the nip portion 142. Accordingly, the heater 160 may intensively heat the nip N and a surrounding portion of the nip N and thereby may reduce an initial warm-up time. Although not shown in FIGS. 1 and 2, a temperature sensor may be further provided in or around the heater 160.

Figure 5:
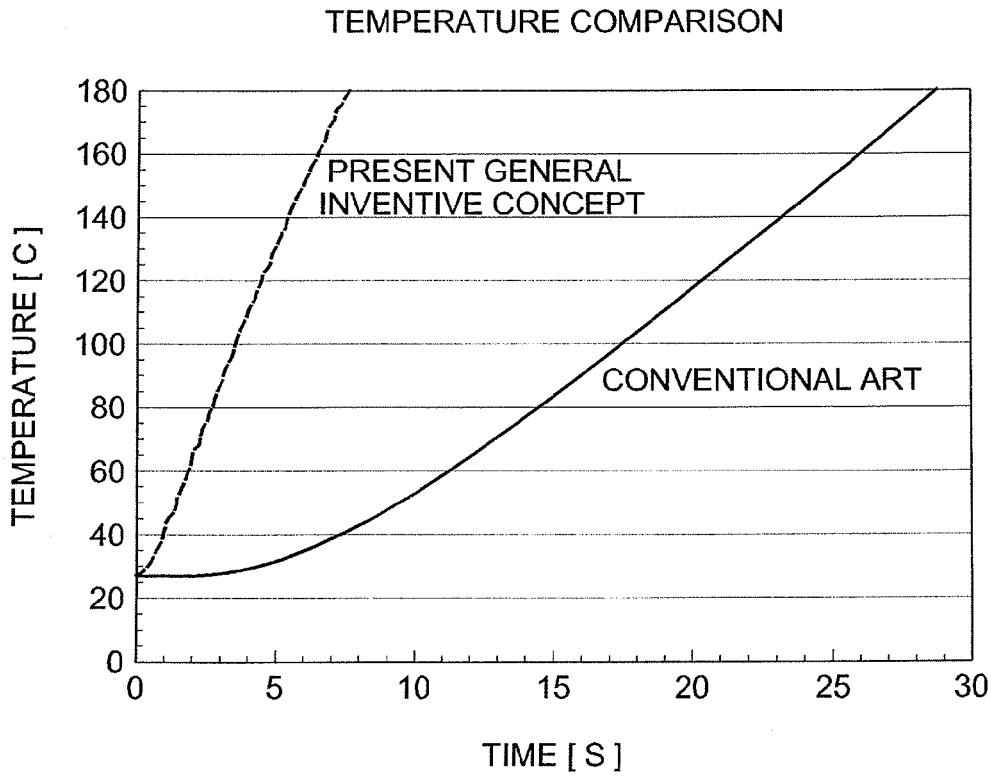
FIG. 5 is a graph comparing a warm-up times between a conventional image heating apparatus using a pressure roller and an image heating apparatus according to an embodiment of the present general inventive concept.

FIG. 5 is a graph comparing warm-up times of a conventional image heating apparatus and an image heating apparatus according to an embodiment of the present general inventive concept.

In this instance, the temperature comparison shown in FIG. 5 corresponds to results acquired by analyzing numerical values. The conventional image heating apparatus used a heater which includes a pressure roller with about 21.8 mm of an external diameter and about 1300 W of heating. Also, the image heating apparatus according to the present general inventive concept uses a heater which includes a belting film with about 24 mm of an external diameter and about 250 W of heating.

Referring to FIG. 5, although the conventional image heating apparatus used the heater with a comparatively greater heating value, the graph shows that a heating speed of the conventional image heating apparatus is less than the heating speed of the image heating apparatus according to the present general inventive concept. Also, the conventional image heating apparatus should heat the entire heating roller and thus the heating speed becomes slow. However, the image heating apparatus according to the present general inventive concept partially heats the belting film with a comparatively thinner thickness and thus the heating speed is comparatively faster. As an example, when it is assumed that temperature needed for warm-up is about 160° C., it generally takes about 5 to 6 seconds to complete the warm-up of the image heating apparatus according to the present general inventive concept. However, under the same conditions, it takes about 25 to 27 seconds to complete the warm-up of the conventional image heating apparatus.

Figure 6A:
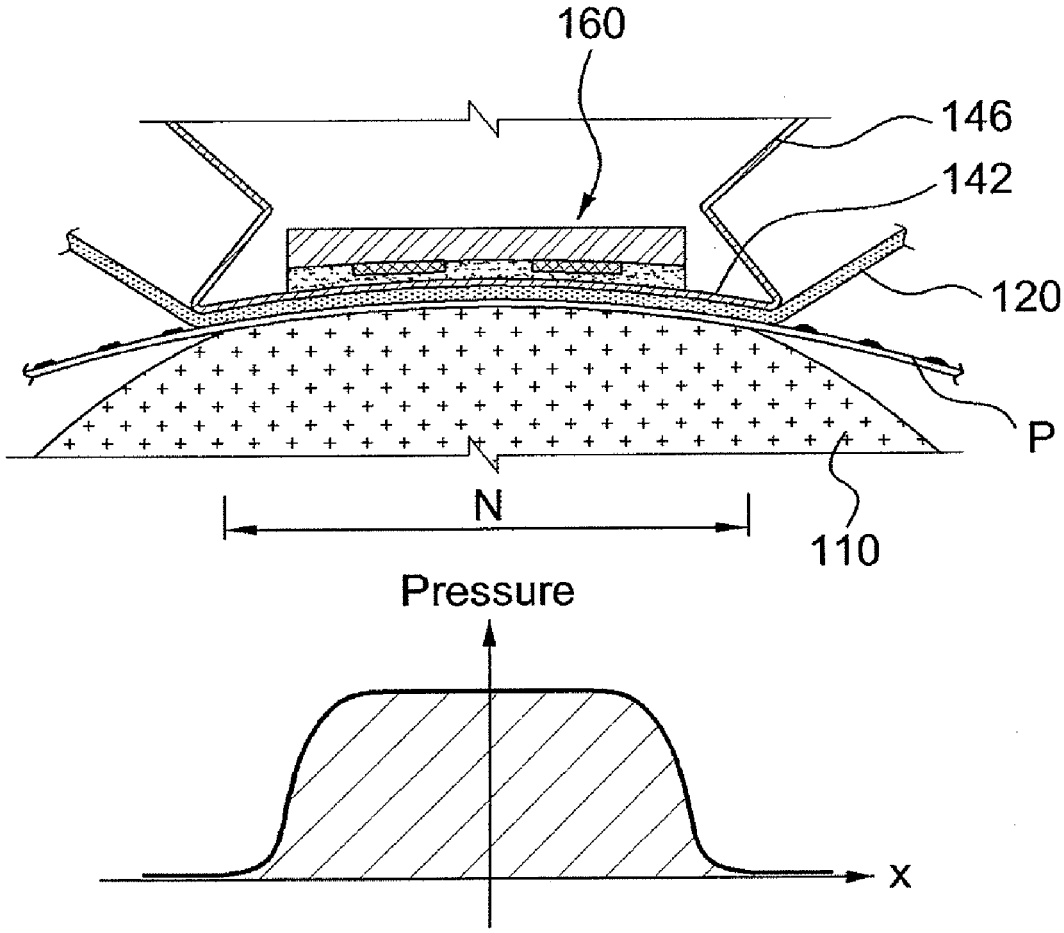
FIG. 6A is a partial enlarged cross-sectional view illustrating a nip in an image heating apparatus and pressure distribution in the nip according to an embodiment of the present general inventive concept.
Figure 6B:
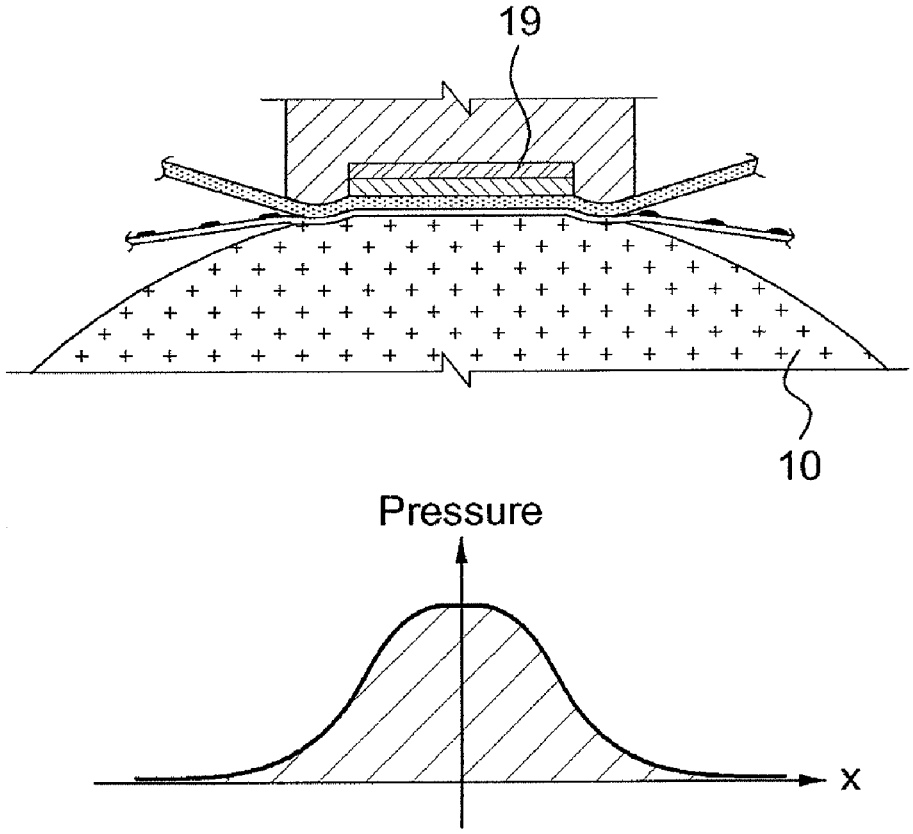
FIG. 6B (CONVENTIONAL ART)
FIG. 6B is a partial enlarged cross-sectional view illustrating a nip in a conventional image heating apparatus and pressure distribution in the nip.

FIG. 6A is a partial enlarged cross-sectional view illustrating a nip in an image heating apparatus and pressure distribution in the nip according to an embodiment of the present general inventive concept, and FIG. 6B is a partial enlarged cross-sectional view illustrating a nip in a conventional image heating apparatus and pressure distribution in the nip. In this instance, the conventional image heating apparatus and the image heating apparatus according to the present general inventive concept may refer to image heating apparatuses shown in FIGS. 2 and 3 respectively.

Referring to FIG. 6A, a film 120 and a recording medium, that is, a printing paper P, pass through a space between a pressure roller 110 and a nip portion 142 supported by a support portion 146. In this instance, the nip portion 142 may be deformed to have a partially curved surface along the shape of the pressure roller 110 due to elastic deformation of a nip spring. Accordingly, the pressure distribution with a comparatively greater width is formed on a central portion of a nip N and the pressure distribution in the nip N is comparatively uniform.

Conversely, referring to FIG. 6B, the conventional image heating apparatus includes a nip between a pressure roller 10 and a heater 19 without a nip spring. In this instance, the heater 19 is not deformed and thus the pressure distribution with a comparatively narrower width is formed in the nip. In this instance, the pressure distribution is formed in which a central portion of the nip has the greatest pressure and the pressure around the central portion is significantly reduced.

Referring again to FIG. 6A, a heater 160 is provided above a top surface of the nip portion 142 and thus the pressure in the nip N is not directly transferred to the heater 160. Therefore, according to the present embodiment, it is possible to arbitrarily increase the pressure in the nip N not to damage the heater 160.

Since the nip portion 142 has an area greater than an area of the heater 160 in a nip direction corresponding to a path of the printing paper P, and the support portion 146 is deformable with respect to the support body 132 to elastically support the nip portion 142, the nip portion 142 can be elastically deformed along a circumference surface of the pressure roller 110 to cover the nip area. It is also possible that a portion of the heater may be deformed to correspond to deformation of the nip portion 142.

Generally, when pressure is increased in the nip N based on a normal heating state, a heating temperature in the nip N may be reduced. In this instance, it is possible to use a heater with a low capacity or to reduce a warm-up time.

Also, it is possible to increase a heating effect in the nip N and thus a passing speed of the recording medium, that is, the printing paper P, may be increased. When the passing speed in the nip N is increased, a printing speed of a copying machine or a printer with the image heating apparatus installed may be increased.

Conversely, referring to FIG. 6B, the conventional image heating apparatus has a structure in which the heater 19 directly receives pressure and thus when the pressure in the nip increases, the heater 19 may be damaged. Therefore, according to the conventional art, it is impossible to arbitrarily increase the pressure in the nip and it is difficult to increase a passing speed of a recording medium in a heating state.

Figure 7A:
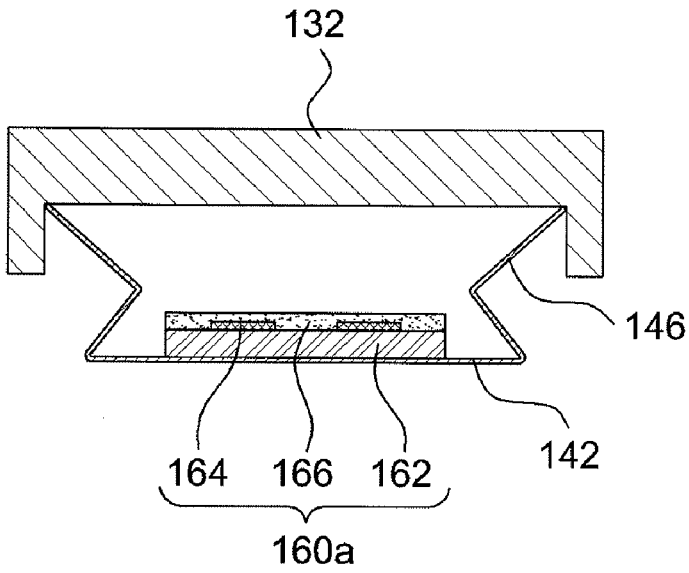
FIGS. 7A through 7C are partial enlarged cross-sectional views illustrating a nip spring and a heater according to another embodiment of the present general inventive concept.
Figure 7B:
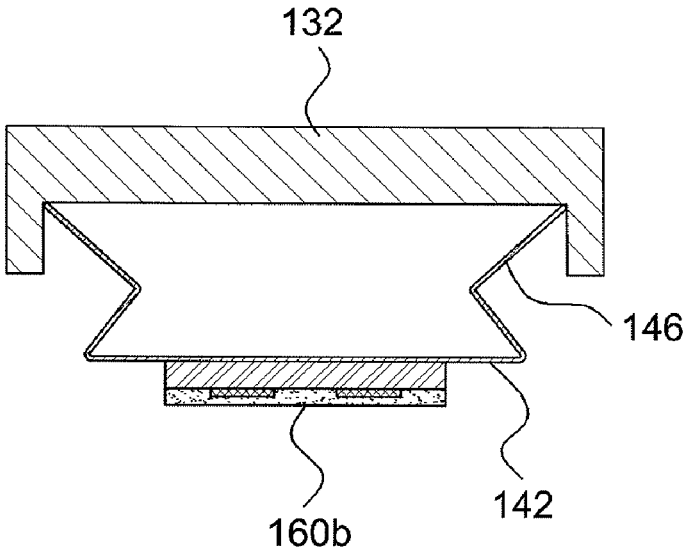
Figure 7C:
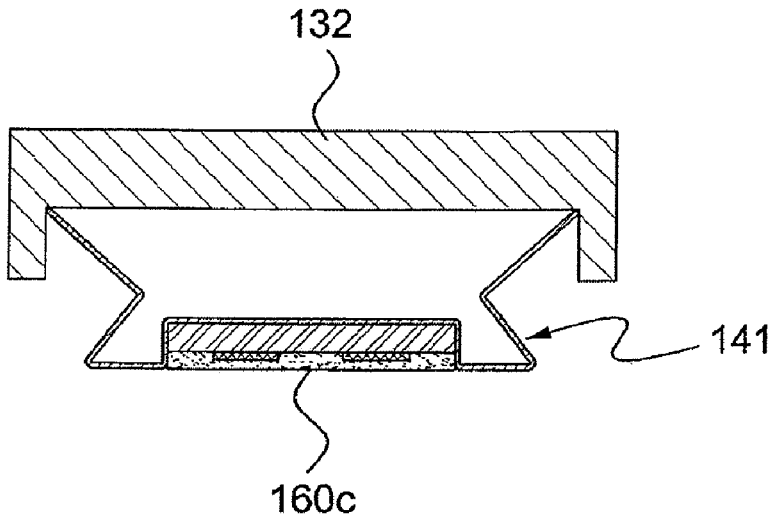

FIGS. 7A through 7C are partial enlarged cross-sectional views illustrating a nip spring and a heater of an image heating apparatus according to another embodiment of the present general inventive concept.

Referring to FIG. 7A, a heater 160*a*, which is similar to the heater 160 shown in FIG. 3, includes a plate 162, a heating pattern 164, and a preventing layer 166. The heater 160*a* is provided in a nip portion 142 of a nip spring 146. In this instance, the plate 164 may be provided on the nip portion 142 and thereby contact with the nip portion 142. The heating pattern 164 and the preventing layer 166 may be sequentially provided on the plate 162.

Referring to FIG. 7B, a heater 160*b* is provided on an outside of a nip spring 146, that is, an external bottom surface of a nip portion 142. In this instance, as described above, the heater 160 directly receives pressure in a nip and thus it may be impossible to increase the pressure in the nip to be greater than a predetermined level, which is to prevent damage of the heater 160.

Referring to FIG. 7C, a heater 160*c* is provided on an outside of a nip spring 141. In this instance, the nip spring 141 may be formed in a different shape instead of a plane, to partially or entirely receive the heater 160. Specifically, the bottom surface of the nip spring 141 may be formed at the same height as the bottom surface of the heater 160*c*, or at a lesser height than the bottom surface of the heater 160. While a nip portion of the nip spring 141 is being partially deformed, it is possible to distribute the pressure applied to the heater 160*c*.

Figure 8:
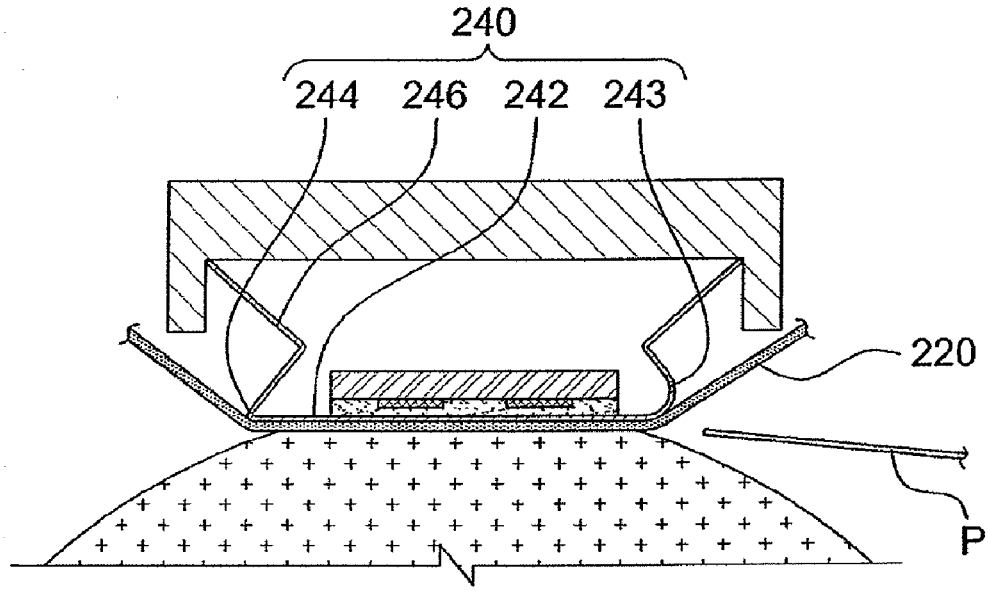
FIG. 8 is a partial enlarged cross-sectional view illustrating a nip spring according to still another embodiment of the present general inventive concept.

FIG. 8 is a partial enlarged cross-sectional view illustrating a nip spring of an image heating apparatus according to still another embodiment of the present general inventive concept.

Referring to FIG. 8, a nip spring 240 includes a nip portion 242 and a support portion 246. A boundary between the nip portion 242 and the support portion 246 may be round-processed. An inlet boundary 243 of the nip portion 242 and the support portion 246 is round-processed with a first shape and thus a film 220 and a recording medium, that is, a printing paper P, may be readily received into a nip. Also, an outlet boundary 244 of the nip portion 242 and the support portion 246 may also be round-processed such that the film 220 and the heated recording medium may be separated from each other with a greater angle.

The round-processed inlet boundary 243 and the outlet boundary 244 may perform a different function and may be formed in a different shape and a different size. As an example, as the inlet boundary 243 has a greater curvature, the film 220 and the recording medium may more be readily received into a nip. Conversely, as the outlet boundary 244 has a comparatively smaller curvature, the film 220 and the recording medium may be readily separated from each other.

The outlet boundary 244 has a bent portion smaller than a bent portion of the inlet boundary 243. That is, the outlet boundary 244 is formed between ends of the support portion 246 and the nip portion 242 to have a small bent portion, and the inlet boundary 243 is formed between another ends of the support portion 246 and the nip portion 242 to have a large bent portion as illustrated in FIG. 8.

Figure 9:
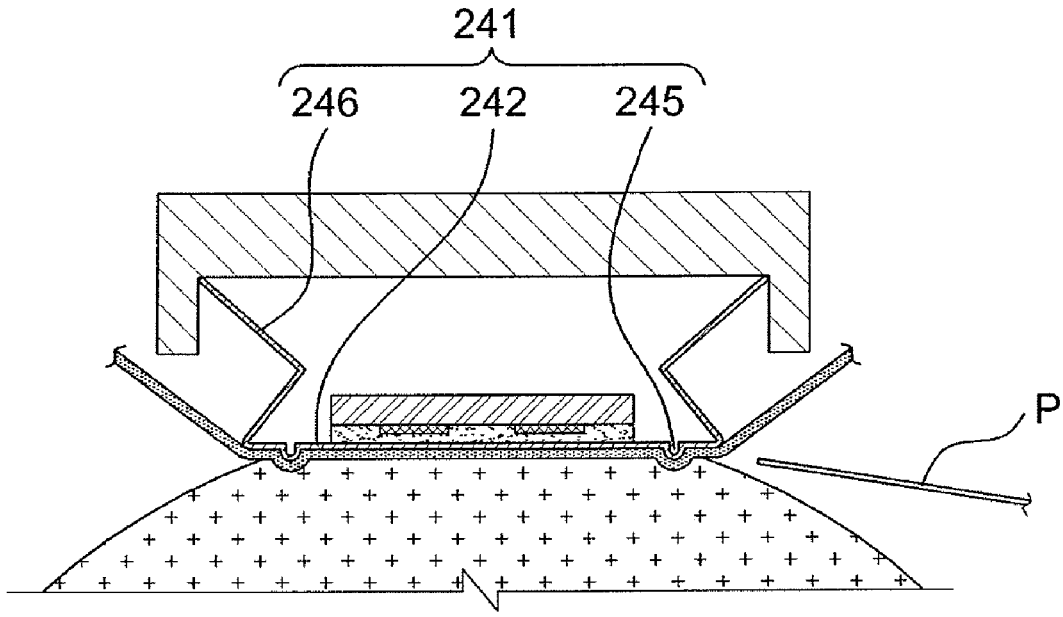
FIG. 9 is a partial enlarged cross-sectional view illustrating a nip spring according to yet another embodiment of the present general inventive concept.

FIG. 9 is a partial enlarged cross-sectional view illustrating a nip spring usable with an image heating apparatus according to yet another embodiment of the present general inventive concept.

Referring to FIG. 9, a nip spring 241 may include a nip portion 242, a supporting portion 246, and a protrusion 245 which is externally formed on a nip portion 242. Since the protrusion 245 is formed, a recording medium, that is, a printing paper P, may be readily received into and be discharged from a nip. Also, the protrusion 245 may prevent the recording medium from being rolled or becoming jammed.

Referring to FIG. 9, although the protrusion 245 is formed on the bottom surface of the nip portion 242 along the lengthwise direction of the nip portion 242 in each of both ends of the nip portion 242, the protrusion 245 may be formed on only one end of the nip portion 242. Also, the protrusion 245 may be continuously or discontinuously formed along the nip portion 242.

Figure 10:
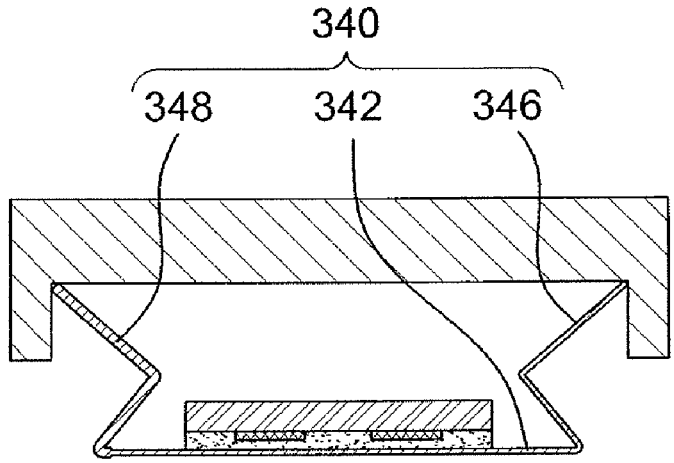
FIGS. 10 through 12 are partial enlarged cross-sectional views illustrating a nip spring according to another embodiment of the present general inventive concept.
Figure 11:
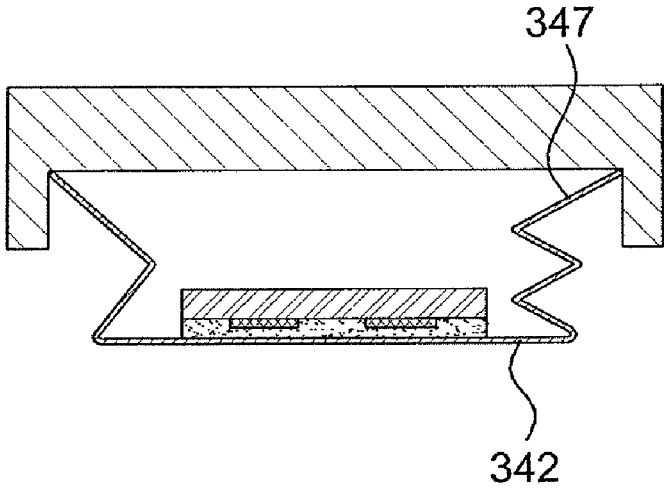
Figure 12:
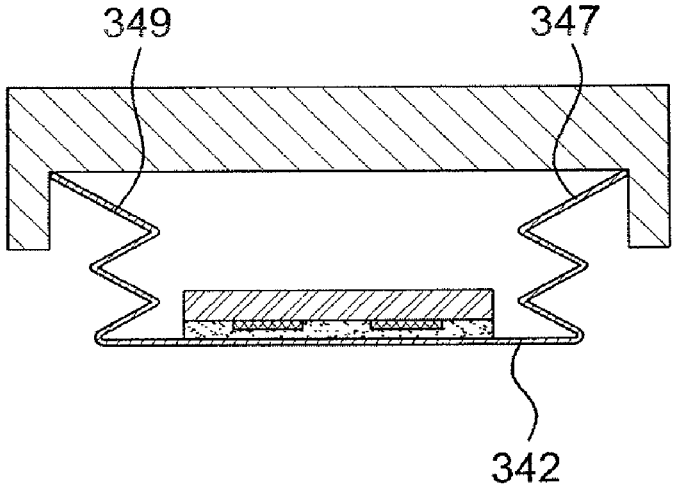

FIGS. 10 through 12 are partial enlarged cross-sectional views illustrating a nip spring 340 usable with an image heating apparatus and/or an image forming apparatus according to another embodiment of the present general inventive concept.

Referring to FIGS. 10 through 12, the nip spring 340 may be symmetrically or asymmetrically formed on a central vertical axis. The nip spring may include support portions 346 and 348, a nip portion 344 formed between the support portions 346 and 348. In this instance, it can be seen that the nip spring 340 is formed to have a symmetrical or asymmetrical cross section.

As an example, referring to FIG. 10, an outlet support portion 348 may have a comparatively thicker thickness than the thickness of an inlet support portion 346 in a nip spring 346. Specifically, the inlet support portion 346 and the outlet support portion 348 are asymmetrically formed and thereby the outlet support portion 348 may have a comparatively greater elastic coefficient. For the operation, the outlet support portion 348 may be formed to have a thicker thickness than the inlet support portion 346. Also, the outlet support portion 348 may have a thicker thickness by including a stiffener plate than the inlet support portion 346.

As described above, the inlet support portion 346 is formed to have a comparatively thinner thickness, and thereby allows a recording medium be readily received into a nip. Also, pressure distribution in the nip may be variously adjusted by adjusting the thickness of the support portion 340 to be symmetrical or asymmetrical using various methods. To improve a heating capacity, the shape of a support portion or a nip portion or other conditions may be variously modified.

In the conventional image heating apparatus, it is very difficult to adjust pressure distribution on a nip. Specifically, while pressure distribution along the lengthwise direction may be adjusted by changing a circumference of a pressure roller along the lengthwise direction of the pressure roller, it may be impossible to adjust the pressure distribution in the nip along a passing direction of a recording medium. However, according to the present general inventive concept, it is possible to change the pressure distribution in the nip along the passing direction of the recording medium. Also, it is possible to uniformly form the pressure distribution with a comparatively greater width. Also, it is possible to variously adjust the pressure distribution in the nip depending upon a heating characteristic.

Also, the pressure distribution in the nip by a nip spring may be adjusted using a different method. As an example, referring to FIG. 11, an inlet support portion 347 may be bent a greater number of times than an outlet support portion and thereby have a different elastic coefficient. Also, referring to FIG. 12, an inlet support portion 347 and an outlet support portion 349 may be bent the same number of times and thereby have a desired elastic coefficient and form a symmetrical structure. Specifically, a support portion 342 may be formed to have a multi-stage in a shape of bellows.

Figure 13:
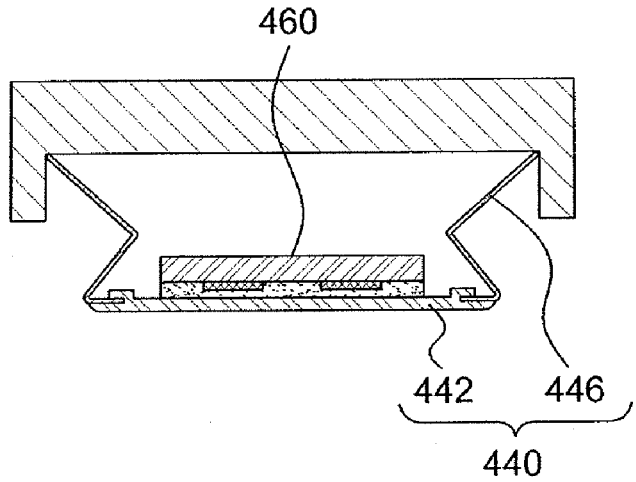
FIG. 13 is a partial enlarged cross-sectional view illustrating a nip spring according to another embodiment of the present general inventive concept.

FIG. 13 is a partial enlarged cross-sectional view illustrating a nip spring 440 usable with an image heating apparatus and/or an image forming apparatus according to another embodiment of the present general inventive concept.

Referring to FIG. 13, a nip portion 442 and a support portion 446 of a nip spring 440 may be formed using different materials respectively. As an example, the nip portion 442 may be formed using a material with a comparatively greater thermal conductivity. Also, the support portion 446 may be separately fabricated and then integrally connect with the nip portion 442. In this instance, heat generated from a heater 460 may be sufficiently transferred to a film.

Figure 14:
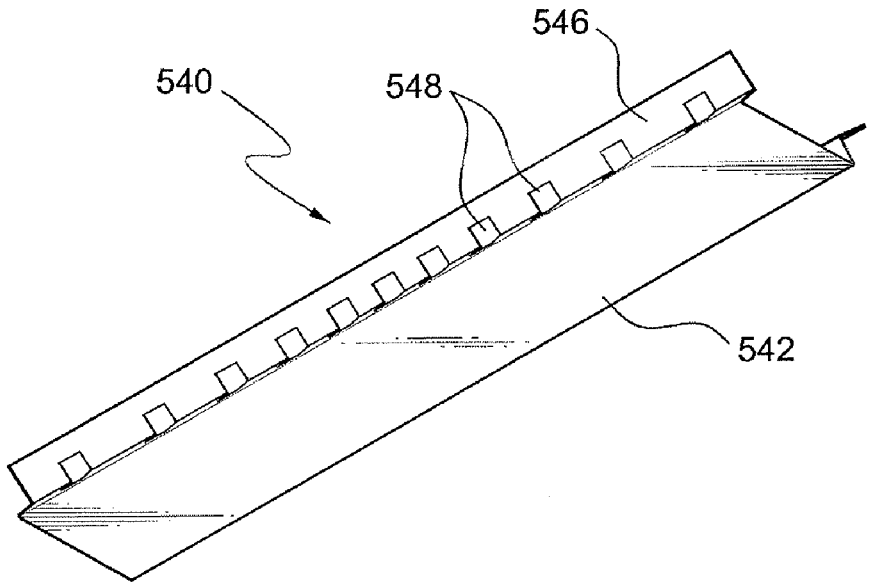
FIGS. 14 and 15 are perspective views illustrating a bottom surface of a nip spring according to another embodiment of the present general inventive concept.
Figure 15:
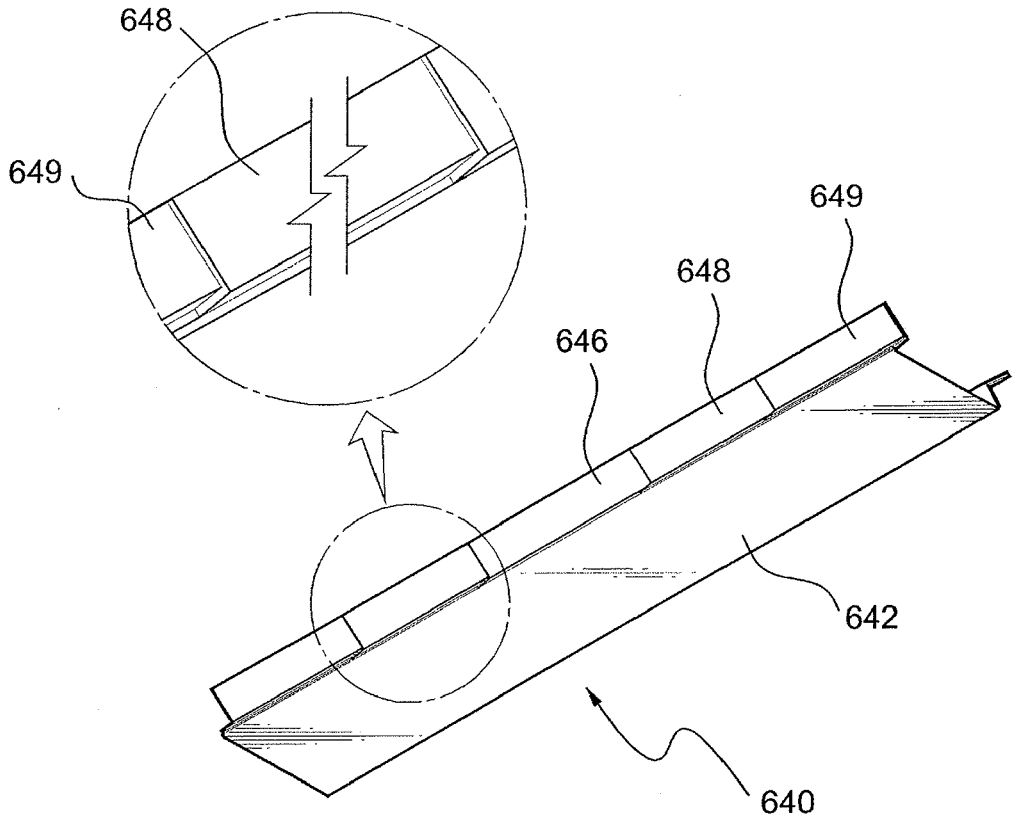

FIGS. 14 and 15 are perspective views illustrating a bottom surface of a nip spring 540 or 640 usable with an image heating apparatus and/or an image forming apparatus according to another embodiment of the present general inventive concept.

Referring to FIG. 14, the nip spring 540 includes a nip portion 542 and a support portion 546. A plurality of holes 548 is formed in the support portion 546. The plurality of holes 548 is used to adjust an elastic coefficient and thus an interval between the plurality of holes 548 is comparatively narrower near a central portion of the support portion 546. Also, as the plurality of holes 548 approaches each end of the support portion 456, the plurality of holes 548 is spaced apart from each other at a greater interval. Accordingly, the central portion of the support portion 546 may have a comparatively smaller elastic coefficient. Conversely, both of the ends may have a comparatively greater elastic coefficient.

In this instance, the elastic coefficient of the support portion 546 may be adjusted by changing the shape of the hole 548. Also, the elastic coefficient may be adjusted by changing the size or location of the hole 548. Also, the elastic coefficient may be adjusted by appropriately providing a stiffener, instead of forming the hole 548.

As an example, referring to FIG. 15, a plurality of stiffeners 648 and 649 may be attached to an external wall of a support portion 646. In a central portion, the support portion 646 is generally formed in a single layer, however, nearer to both ends of a nip portion 642, a wall body may be formed in two layers or three layers by attaching the plurality of stiffeners 648 and 649 to the support portion 646. Accordingly, an overlapped portion may have a comparatively greater elastic coefficient.

Figure 16:
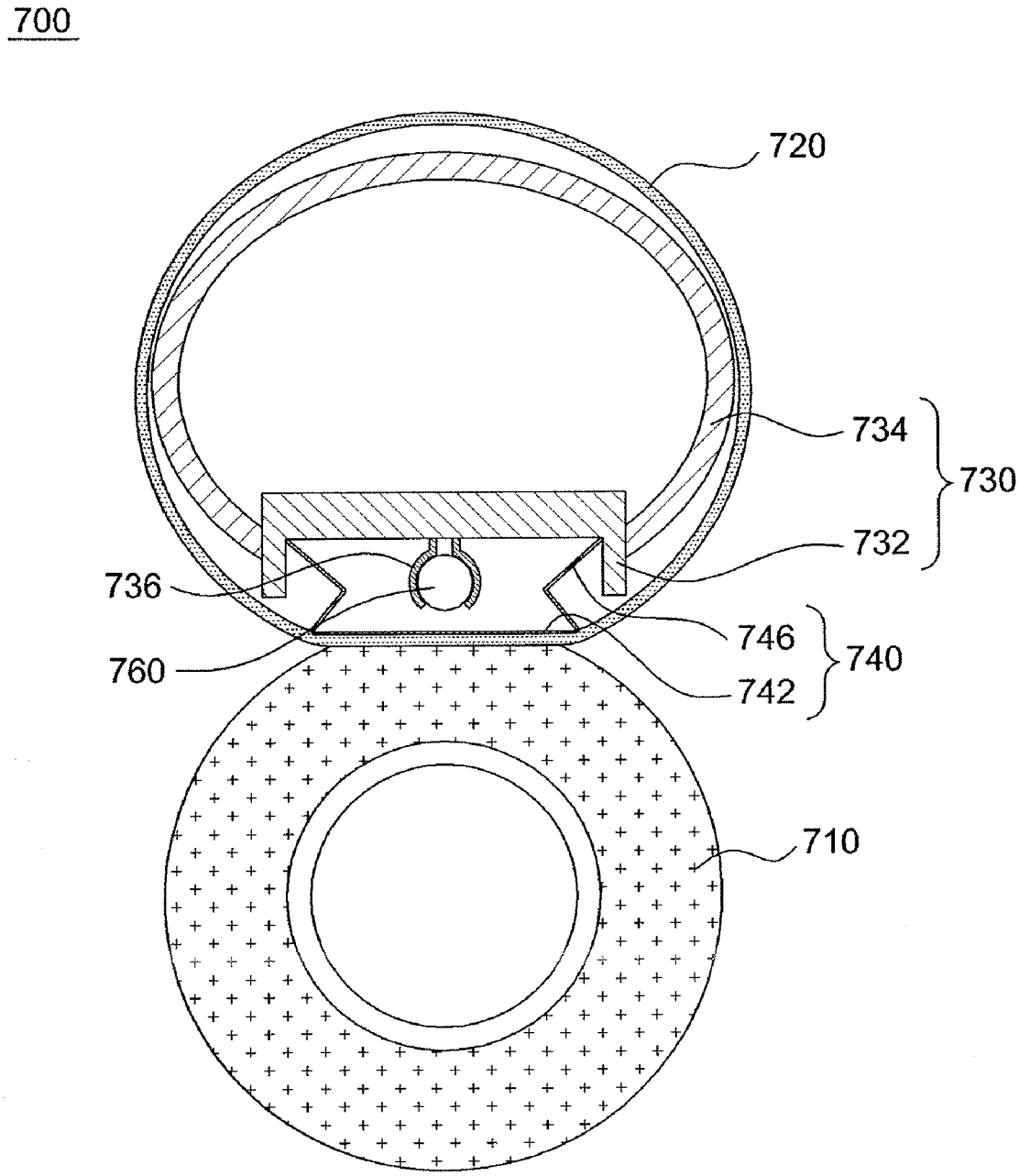
FIG. 16 is a cross-sectional view illustrating an image heating apparatus according to an embodiment of the present general inventive concept.

FIG. 16 is a cross-sectional view illustrating an image heating apparatus 700 usable with an image heating apparatus according to an embodiment of the present general inventive concept.

Referring to FIG. 16, the image heating apparatus 700 includes a pressure roller 710, a belting film 720, a support member 730 having a support body 732 and a guide 734, a nip spring 740 having a nip portion 742 and a support portion 746, and a heater 760. The support member 730 is provided above the pressure roller 710. Also, the nip spring 740 and the heater 760 are mounted to the support member 730. The belting film 720 contains the support 730, the nip spring 740, and the heater 760, and may pass through a space between the pressure roller 710 and the nip spring 740. In this instance, the nip spring 740 may elastically support the belting film 720, and include a nip formed between the pressure roller 710 and the nip spring 740.

In the present embodiment, the heater 760 may be fixed to the support member 730, instead of being provided in a nip portion 742 of the nip spring 740. A halogen lamp may be used for the heater 760.

Also, the pressure roller 710 is mounted to a fixed axis and includes a surface layer formed using rubber or an elastic material. The support member 730 is also provided in a fixed location above the pressure roller 710. In this instance, the support member 730 may include a heater clamp 736 to fix the heater 760, and may form the heater 760 in a comparatively fixed location with respect to the nip spring 740. The belting film 720 may be formed using a heat resistant material and partially transfer heat, generated from the heater 760, to a toner image.

Figure 17:
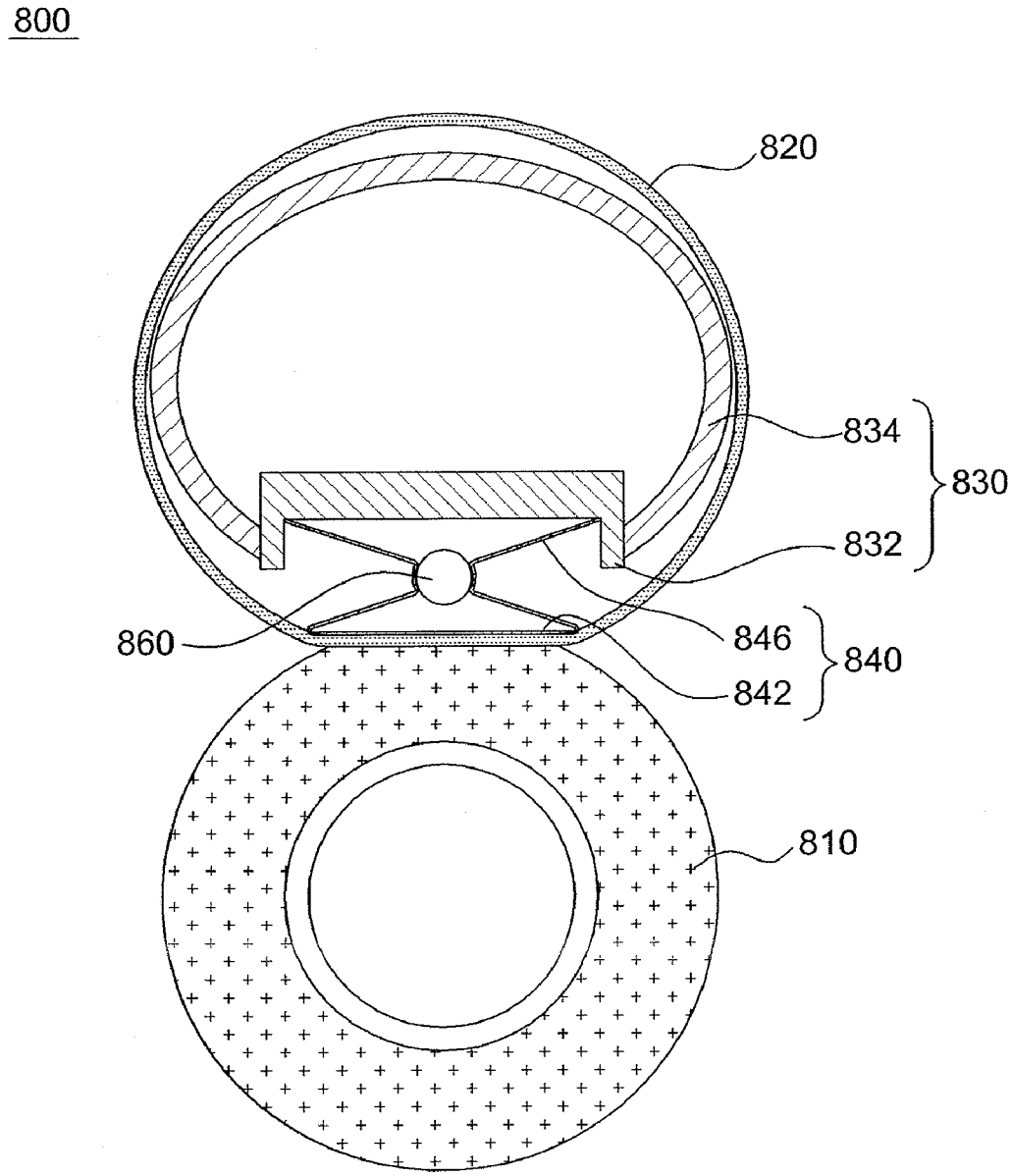
FIG. 17 is a cross-sectional view illustrating an image heating apparatus according to another embodiment of the present general inventive concept.

FIG. 17 is a cross-sectional view illustrating an image heating apparatus 800 according to another embodiment of the present general inventive concept.

Referring to FIG. 17, the image heating apparatus 800 includes a pressure roller 810, a belting film 820, a support member 830 having a support body 832 and a guide 834, a nip spring 840 having a nip portion 842 and a support portion 846, and a heater 860. The support member 830 is provided above the pressure roller 810. Also, the nip spring 840 and the heater 860 are mounted to the support member 830. The belting film 820 contains the support 830, the nip spring 840, and the heater 860, and may pass through a space between the pressure roller 810 and the nip spring 840. In this instance, the nip spring 840 may elastically support the belting film 820, and include a nip formed between the pressure roller 810 and the nip spring 840.

In the present embodiment, the heater 860 is partially received by a support portion 846, instead of being provided to a nip portion 842 of the nip spring 840. In this instance, the heater 860 may be fixed by a structure of the support portion 846, and the heater 860 may partially heat the belting film 820 and the nip spring 840 through thermal radiation and conduction.

According to the embodiments of the present general inventive concept, a nip spring may be elastically deformed in correspondence to a shape of a pressure roller or a recording medium, that is, a printing paper. Accordingly, pressure distribution may be uniformly formed in a nip, and pressure sufficient for a heating operation may be provided.

Also, an elastic characteristic may be variously changed by changing a shape of a nip spring or a material characteristic, and thus a manufacturer may variously manufacture the nip spring depending upon a condition of a nip. As an example, an elastic coefficient may be adjusted by forming a hole in the nip spring. Also, it is possible to facilitate receiving and discharging of the recording medium by changing the shape of an inlet support portion and an outlet support portion.

Also, according to the embodiments of the present general inventive concept, a comparatively wider nip may be formed due to a nip spring. Accordingly, it is possible to increase an effective width of the nip and also increase a passing time of a recording medium in the nip and thereby to improve a heating capacity. Also, it is possible to increase a passing speed of the recording medium in the nip.

Also, according to the embodiments of the present general inventive concept, an initial warm-up time of a nip may be quickly completed. Accordingly, it is possible to increase the pressure in the nip, based on a normal heating state and thereby to reduce a heating temperature in the nip. Also, it is possible to use a heater with a relatively low capacity.

Also, according to the embodiments of the present general inventive concept, the heater may quickly transfer heat due to the nip spring and thus an initial warm-up operation may be completed within a comparatively shorter time. Also, the nip with a desired characteristic may be readily provided by adjusting a characteristic of the nip spring.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image heating apparatus comprising:

a pressure member;

a film to form a nip with the pressure member;

a heater to be provided adjacent to the nip; and a nip spring to elastically support the film in correspondence to the nip.

2. The apparatus of claim 1, further comprising:

a support member to support the nip spring, wherein the nip spring comprises:

a nip portion to form the nip, and a support portion to support the nip portion against the support member.

3. The apparatus of claim 2, wherein the heater is mounted to be movable with respect to the support member.

4. The apparatus of claim 3, wherein the heater is provided on one surface of the nip portion.

5. The apparatus of claim 2, wherein the heater is fixed to the support member.

6. The apparatus of claim 5, wherein the heater is provided adjacent to the nip portion.

7. The apparatus of claim 1, wherein the film is formed in a shape of a belt and circulates around the heater and the nip spring.

8. An apparatus to heat an image on a recording medium and to fuse the image, the apparatus comprising:

a pressure roller;

a belting film to circulate while partially connecting with the pressure roller;

a support member to be provided in the belting film and comprises a guide to guide the belting film to circulate therealong;

a nip spring to support an inner surface of the belting film and comprises a nip portion to form a nip between the belting film and the pressure roller, and a support portion to elastically support the nip portion against the support member; and a heater to be provided adjacent to the nip spring and transfer heat to the image through the belting film.

9. The apparatus of claim 8, wherein the heater is mounted to the nip portion.

10. The apparatus of claim 9, wherein the heater is provided in an inner surface of the nip portion.

11. The apparatus of claim 8, wherein the heater is fixed to the support member.

12. The apparatus of claim 8, wherein the nip portion is adaptable to the shape of the nip.

13. The apparatus of claim 8, wherein the nip spring has a symmetrical or asymmetrical cross section.

14. The apparatus of claim 8, wherein the nip spring has a cross section with a regular or irregular thickness.

15. The apparatus of claim 8, wherein the support portion is provided as a structure with at least one bend.

16. The apparatus of claim 8, wherein a boundary between the nip portion and the support portion is round-processed.

17. The apparatus of claim 16, wherein an inlet has a curvature greater than a curvature of an outlet in the boundary between the nip portion and the support portion.

18. The apparatus of claim 8, wherein at least one protrusion is formed on a bottom surface of the nip portion towards the pressure roller.

19. The apparatus of claim 8, wherein the support portion has a different elastic coefficient along the lengthwise direction.

20. The apparatus of claim 19, wherein the support portion has a different elastic coefficient along the lengthwise direction, based on a formation of a hole, an adjustment of the thickness, a providing of a stiffener, or a difference of a shape.

21. A method of heating an image, the method comprising:

forming a nip using a pressure roller and a film which partially connects with the pressure roller;

elastically supporting the film in correspondence to the nip by using a nip spring;

driving the pressure roller to pass a recording medium, with the image formed on the recording medium, via the nip; and transferring heat to the image passing through the nip using a heater which is provided adjacent to the nip.

22. The method of claim 21, wherein the film is formed in a shape of a belt and circulates around the heater and the nip spring.

23. The method of claim 21, wherein the heater is mounted to the nip spring to move with the nip spring.

24. The method of claim 23, wherein the heater is provided in the nip spring to indirectly connect with the film.

25. The method of claim 21, wherein the nip spring comprises a nip portion to support the film and a support portion to support the nip portion against a support member, and the nip spring is formed using an elastic material to be adaptable to the shape of the nip.

26. The method of claim 25, wherein the nip spring has one of a symmetrical cross section and an asymmetrical cross section.

27. The method of claim 25, wherein the nip spring has a cross section with a regular or irregular thickness.

28. The method of claim 25, wherein the support portion has a different coefficient along a lengthwise direction thereof.

29. An image forming apparatus comprising:

a processing unit to form an image on a printing medium; and an image heating apparatus comprising a pressure member, a film to form a nip with the pressure member such that the printing medium with the image passes through the nip, a heater provided adjacent to the nip to apply heat to the printing medium, and a nip spring to elastically support the film with respect to the pressure member.

30. An image forming apparatus comprising:

a processing unit to form an image on a printing medium; and an image heating apparatus comprising a pressure member, a film to form a nip with the pressure member such that the printing medium with the image passes through the nip, a guide to guide the film to rotate along a path including the nip, a nip spring mounted on the guide to elastically support the film with respect to one of the pressure member and the guide, and a heater mounted on the nip spring to apply heat to the printing medium.

* * * * *